United States Patent [19]

Lovas

[11] Patent Number: 4,817,380

[45] Date of Patent: Apr. 4, 1989

[54] PROCESS AND DEVICE FOR PIECING UP AN OPEN-END FRICTION SPINNING DEVICE

[75] Inventor: Kurt Lovas, Bohmfeld, Fed. Rep. of Germany

[73] Assignee: Schubert & Salzer, Ingolstadt, Fed. Rep. of Germany

[21] Appl. No.: 27,226

[22] PCT Filed: Jun. 5, 1986

[86] PCT No.: PCT/DE86/00234

§ 371 Date: Jan. 5, 1987

§ 102(e) Date: Jan. 5, 1987

[87] PCT Pub. No.: WO87/00214

PCT Pub. Date: Jan. 15, 1987

[30] Foreign Application Priority Data

Jun. 24, 1985 [DE] Fed. Rep. of Germany ..... 3522518

[51] Int. Cl.[4] ..... D01H 7/882; D01H 15/02

[52] U.S. Cl. ..... 57/263; 57/401

[58] Field of Search ..... 57/263, 264, 301, 401

[56] References Cited

U.S. PATENT DOCUMENTS

| | | | |
|---|---|---|---|
| 4,514,972 | 5/1985 | Stahlecker | 57/301 |
| 4,570,430 | 2/1986 | Stahlecker | 57/263 |
| 4,586,325 | 5/1986 | Wassenhoven | 57/263 |
| 4,598,539 | 7/1986 | Stahlecker et al. | 57/263 |
| 4,606,184 | 8/1986 | Stahlecker et al. | 57/263 |
| 4,617,790 | 10/1986 | Stahlecker | 57/263 |
| 4,627,230 | 12/1986 | Stahlecker | 57/264 X |
| 4,628,685 | 12/1986 | Stahlecker et al. | 57/263 |

FOREIGN PATENT DOCUMENTS

| | | |
|---|---|---|
| 34427 | 8/1981 | European Pat. Off. . |
| 125341 | 11/1984 | European Pat. Off. . |
| 3148068 | 7/1982 | Fed. Rep. of Germany . |
| 3220713 | 2/1983 | Fed. Rep. of Germany . |
| 3318266 | 11/1984 | Fed. Rep. of Germany . |
| 3340435 | 5/1985 | Fed. Rep. of Germany . |
| 3342472 | 6/1985 | Fed. Rep. of Germany . |
| 1205031 | 9/1970 | United Kingdom . |
| 1205032 | 9/1970 | United Kingdom . |
| 1205033 | 9/1970 | United Kingdom . |

*Primary Examiner*—Joseph J. Hail, III

*Attorney, Agent, or Firm*—Dority & Manning

[57] ABSTRACT

To piece up to a spinning station consisting of two friction spinning elements (101) driven in the same direction and forming a nip, a thread 30 is conveyed to the nip so that said thread 30 reaches the thread forming zone (104) with its free thread end first. Feeding of the fibers into the nip is controlled so that the thread end (300) comes into contact with the fibers simultaneously with its reaching the thread forming zone (104). The friction spinning elements (101) are covered by a cover (130) which incorporates a fiber feeding channel (24). The cover, in addition to the fiber feeding channel (24), is equipped with a thread insertion slit (14) extending essentially in the longitudinal direction of the friction spinning elements (101). The thread insertion slit (14) extends from the outside of the cover (130) up to its inside, and from the end on the draw-off side up to the outlet end (240) on the side away from the drawoff. A thread holding device (7) which holds the thread (30) essentially parallel to the thread insertion slit (14) is installed outside the nip. The thread holding device (7) holds the thread (30) away from the nip, at the end of the friction spinning elements (101) closest to the draw-off for as long as the thread end (30) has not reached the nip.

41 Claims, 5 Drawing Sheets

PROCESS AND DEVICE FOR PIECING UP AN OPEN-END FRICTION SPINNING DEVICE

BACKGROUND OF THE INVENTION

The instant invention relates to a device for piecing up an open-end friction device equipped with two friction spinning elements, driven in the same direction, and forming a nip subjected to suction, to which a thread end is fed into a piecing position outside of the nip and is delivered therefrom into a thread forming zone in the nip. It is drawn off from said zone in the form of a continuous thread as fibers fed to the nip are incorporated into it. The invention also relates to a device to carry out this process.

In a known process of this type, the thread end is fed back from outside the nip as far as a suction nozzle by means of a guide, with the cover being open (see German published application No. 3,318,266). By means of an appropriate movement or a suitable drive of the guide, an intermediate segment of the thread is delivered to the nip of the friction spinning elements which formerly have been stopped. The cover is then closed and the thread draw-off is switched on. The friction spinning elements are again driven and the fiber feeding is started so that the fibers reach the nip at the same time as the thread end. Since the desired amount of fibers fed does not get into the nip all at once but only gradually, a thin segment of thread cannot be avoided following the point where the thread end is combined with the fibers. Such a thin segment leads to increased thread breakage because of lower strength. However, if the fiber feeding starts up before the thread end is pulled out of the suction nozzle, and gets into the nip, a long joint, constituting a thick segment is formed, and this is undesirable for reasons of appearance.

SUMMARY OF THE INVENTION

It is therefore an object of the invention to create a process and a device for securely piecing up an open-friction spinning device and thus to reduce the size of the faulty segment produced by the piecing.

This object is achieved according to the invention in that the thread is fed to the nip in such manner as to cause the thread to reach the thread forming zone with its free thread end first and by controlling the feeding of the fibers into the nip so that the thread end comes into contact with the fibers at the same time as it reaches the thread forming zone. The thread segment coming into contact with the fibers is thus quite short.

This thread segment is now drawn off from the nip and incorporates at the same time the fibers fed into the nip. Since the thread end comes into contact with the fibers only when it reaches the fiber forming zone and since it already is in the nip at the beginning of the spinning process and does not yet have to be brought into said nip after another thread segment has already started to incorporate fibers, the faulty segment in the newly pieced thread is very short and generally is even shorter than the length of the fiber feeding zone which is determined by the length of the outlet of the fiber feeding channel. Here, the thick segment in the thread joint is even shorter since not the entire length of the thread being fed back into the longitudinal reach of the friction spinning elements gets into the nip, but only the end segment of the thread away from the draw-off side. A thin segment, following the thread joint can be avoided through time-control of the beginning of fiber feeding which can be controlled independently from the thread feeding into the nip.

The process according to the invention in which the thread reaches the thread forming zone first with its free end, shall also include a process in which only the end segment of the fed-back thread reaches the thread forming zone and the thread segment between the end segment and the end on the draw-off side of the nip does not get into the thread forming zone at all. After completion of the piecing process, the former thread end, which now forms this intermediate segment of the thread, arrives in the nip zone on the draw-off side during the draw-off movement of the thread, i.e., also after the thread end used for piecing has been fed into the thread forming zone.

In order to avoid thin segments in the piecing joint, the invention provides for the feeding of the fibers into the nip to begin before the thread end has reached the thread forming zone. The thread end is laid on the accumulated fiber mass in the nip which is then tied into the thread end together with newly arrived fibers. This makes it possible to determine the quantity of fibers to be tied into the piecing joint in a simple manner.

It has been shown that once fiber feeding is stopped, fibers which are combed out of the fiber tuft reaching into the combing range of the opening device, or those which are still in the garniture of the opening roller, continue to reach the nip. These fibers are no longer subjected to any draw-off and can cause damage to the friction spinning elements. For this reason, the invention provides for a process in which not only fiber feeding to the friction spinning elements is interrupted when a thread breaks, but where the friction spinning elements are also stopped simultaneously. They are started up again during feedback of the thread into piecing position outside the nip, whereupon fiber feeding into the nip is resumed.

In a preferred embodiment of the process of the invention, fibers are briefly fed to the suction subjected nip while the friction spinning elements are stopped, whereupon the suction of the nip is interrupted and the fibers are sucked out of the nip. The friction spinning elements are then started up once more and the feeding of the fibers into the nip is resumed in timely coordination with its prior interruption.

In order to obtain a longer period of time for the piecing, a further preferred embodiment of the invention provides for the friction spinning elements to be driven at reduced rotational speed during the feeding of the thread end into the thread forming zone until the draw-off of the thread begins.

Different methods can be used to feed the thread to the nip in such a way that its free end reaches the thread forming zone first or that it alone reaches it. A simple method consists in drawing off the thread from the thread forming zone so that it is turned around in the direction of the fiber feeding side.

In a further preferred embodiment of the invention, the thread is fed radially to the nip so that the thread is laid on the friction spinning element rotating toward the nip and is brought into the nip by said friction spinning element. Such a method is suction air saving. In this case, the thread end is preferably laid obliquely on the friction spinning element rotating toward the nip so that the free end of the thread is at a shorter distance from the nip than the thread segment which is on the draw-off side of this friction spinning element.

According to a preferred process, the piecing position is selected so that the thread brought into the piecing position and delivered into the thread forming zone only extends as far as the reach of that zone of the thread forming zone to which the fibers are fed before it is subjected to draw-off. Since the thread end does not extend beyond the reach of that zone of the thread forming zone, to which fibers are fed at the time when it reaches the thread forming zone, fiber feeding can begin even before the thread to be joined reaches the thread forming zone. This prefeeding possibility has the advantage of providing a relatively longer time period for the start-up of fiber feeding.

It is advantageous, in this case, if the thread is brought to a defined length, is fed back for a defined path outside the nip up to the longitudinal reach of the fiber forming zone. The thread end is held in this position by clamping means. The fibers are then fed to the nip and the thread is then laid on the fibers, which are in the nip. In this manner the piecing process can be controlled precisely and simply.

Fewer fibers are available for piecing when thin threads are involved, due to the ratio between fiber feeding speed and thread draw-off speed required here. Since this increases the risk of thread breakage during piecing, a further embodiment of the invention provides for the clamping of the end of the thin thread to occur at a greater distance from the draw-off end of the nip than when thick threads are involved. In this way thin threads remain in the nip longer than thick threads, and this compensates for the differences of speed ratios between fiber feeding and thread draw-off for the duration of the piecing process. This provides for secure piecing.

Piecing can also be done with the free thread end arriving in the nip while the thread is still held by the clamp. This ensures that the thread end always arrived into the nip before the thread segment facing at the draw-off end arrives into the nip. It has proven advantageous, however, to discontinue thread clamping while the thread end is laid on the fibers whioh are in the nip. This makes for precision of control and compact spinning device construction.

Exactness, in the start-up of the thread draw-off is achieved in a variation of the inventive process by feeding the thread to be pieced to the nip first, by means cf clamping device capable of being moved in the direction of thread draw-off, without having the clamping device release the thread, and by having the thread drawn off from the nip by this mobile clamping device.

The thread drawn off from the nip by the movable clamp is, preferably, delivered to a storage which compensates for the draw-off variations occurring when draw-off is taken over by the draw-off device which normally effects thread draw-off during spinning. Similarly, such a storage device can also be used to provide intermediate storage for the excess thread length when the thread is transferred from the movable clamping device to the bobbin.

According to the invention, the thread to be brought into piecing position at the time of a bobbin replacement is preferably brought by means of the clamping device, which is movable in direction of drawoff, first to the nip and then to the storage device, from which the thread is delivered to a newly inserted empty bobbin.

The thread is conveyed from the clamping device into the nip by the suction air at the friction spinning elements. This conveying of the thread to the nip can be assisted by a stream of compressed air directed into the nip.

In a further embodiment of the invention, piecing can also be effected by bringing the thread to a defined length and back feeding it for a defined path outside of the nip, over and beyond the end of the thread forming zone furthest from draw-off, up to the range of influence of an elastic retention force. The fibers are then fed to the nip and the thread is drawn off counter to the elastic retention force and is laid on the fibers which are in the nip after it leaves the range of effectiveness of said elastic retention force.

In order to increase piecing security when thin threads are pieced, a preferred method consists in laying finer threads on the fibers in the nip later than with thicker threads. In this way, the fibers can be pre-fed over a relatively long period of time so that a sufficient amount of fibers is available for the piecing in spite of the reduced fiber quantity delivered per time unit. According to the invention, this can be further assisted by subjecting the thread to a delayed draw-off after it reaches the thread forming zone.

To carry out the process, the open-end friction spinning device is equipped with a cover for the friction spinning elements. The cover is provided with a fiber feeding channel and, side by side to said fiber feeding channel, a thread insertion slit which extends essentially in the longitudinal sense of the friction spinning elements. The slit extends from the outside of the cover up to its inside and from the fiber feeding channel end on the draw-off side to the outlet end of said fiber feeding channel opposite the draw-off side. A thread holding device is installed outside of the nip to hold the thread essentially parallel to the thread insertion slit. There is also provided a thread guide which keeps the thread away from the nip on the draw-off end of the friction spinning elements for as long as the thread end has not reached the nip. The thread insertion slit makes it possible for the thread to remain outside of the thread forming zone during its feedback into piecing position and to be guided out of this piecing position to the thread forming zone while the cover is closed. To ensure secure introduction of the thread into this thread insertion slit, the thread is held by the thread holding device in a parallel position to the thread insertion slit. This thread holding device is installed and controlled so that, together with a thread guide, it releases the thread in such manner as to cause said thread to reach, first or solely, the thread forming zone with its free end, while the thread segment between the thread end and the nip end on the draw-off side reaches the thread forming zone with a delay or not at all.

The thread guide can be formed in different ways and under certain circumstances can be the thread holding device itself. According to a simple embodiment of the invention, the thread guide is formed as a deflector which turns the thread around in the direction of the cover as it leaves the friction spinning elements.

The thread insertion slit can also be made in different ways. For example, depending on the design of the thread holding device, it may be an advantage if the thread insertion slit, following its zone extending from the outside of the cover to its inside, has a zone away from the draw-off side which is separated from the inside of the cover by a slit bottom, where the slit bottom forms a sharp angle with the inside wall of the cover. This is especially useful when the thread holding device is made in the form of a suction air nozzle which runs into the end of the thread insertion slit furthest from the draw-off side. This suction air nozzle takes up the fed-back thread and then releases it again gradually after the start-up of the thread draw-off process where the thread is prevented by a thread guide from getting into the thread forming zone. This becomes possible for the thread end only after its release from the suction air nozzle.

To achieve the space saving design of the object of the invention, it is best for the suction air nozzle to be located in the slit bottom. In such case, the air nozzle best ends parallel to the thread forming zone in the slit bottom.

However, the instant invention is not bound to any particular design of the thread holding device. In one preferred embodiment, for example, it is made in the form of a thread clamp. It is an advantage to equip this thread clamp with a cutting device giving the thread a defined length and form.

Such a design is especially advantageous if its thread clamp can be moved from a thread take-up position for taking up a thread drawn off from a bobbin into a thread delivery position for the delivery of the thread into the thread insertion slit. To control the piecing process, the movable thread clamp can be equipped with a switch which is connected to controls for the control of the piecing process and which can be activated from the cover when the thread delivery position is reached.

Preferably, the thread clamp is movable along the thread insertion slit where the thread clamp can be moved for transforming the thread to the thread insertion slit, in the direction of the thread draw-off, up to the outlet of a pneumatic storage. This storage is located between the friction spinning element and the winding device and said thread clamp is controlled so that it releases the thread only in the zone of the pneumatic storage. In this way the defined piecing conditions are achieved in a simple way since thread feeding into the thread forming zone, as well as draw-off of the pieced thread from said thread forming zone, is effected by one and the same element, i.d., the thread clamp.

To start a new bobbin, it can be an advantage if an auxiliary thread is available for piecing. For this reason the invention provides for an auxiliary bobbin to be installed on a service carriage traveling alongside a plurality of open-end friction spinning devices, whereby the thread can be fed from said auxiliary bobbin to the thread clamp. For this purpose, the thread clamp itself can gather up the length of thread required for piecing. However, a separate feeding device can be provided for that purpose, where, depending on the design of the device, the thread extending toward the auxiliary bobbin can be cut for each piecing procedure between auxiliary bobbin and thread clamp.

To start a new bobbin, it can be an advantage if an auxiliary thread is available for piecing. For this reason the invention provides for an auxiliary bobbin to be installed on a service carriage traveling alongside a plurality of open-end friction spinning devices, whereby the thread can be fed from said auxiliary bobbin to the thread clamp. For this purpose, the thread clamp itself can gather up the length of thread required for piecing. However, a separate feeding device can be provided for that purpose, where, depending on the design of the device, the thread extending toward the auxiliary bobbin can be cut for each piecing procedure between auxiliary bobbin and thread clamp.

To assist the insertion of the thread into the thread insertion slit, a stationary as well as a mobile thread clamp is equipped with a compressed air nozzle directed into the thread insertion slit to blow the thread into said thread insertion slit.

According to a preferred embodiment of the invention, the fiber feeding channel runs into the nip while the thread insertion slit ends outside the nip and faces the peripheral surface of the friction spinning element which rotates toward the nip. Provisions are suitably made in this case for the end of the thread insertion slit on the draw-off side to be at a greater distance from the thread forming zone than its end away from a draw-off. This embodiment of the invention ensures in a simple manner that the free thread end reaches the thread forming zone earlier than the intermediate thread segment between the thread end and the nip end nearest the side of draw-off when the thread is conveyed to the thread forming zone. It has been found to be an advantage if the angle between the end of the outlet of the thread insertion slit which ends on the inside of the cover and the thread forming zone is greater than 90°.

To ensure maximum uniformity of thread feeding to the nip, the thread insertion slit should preferably form an angle of inclination of less than 90° with the direction of rotation of the friction spinning element rotating toward the nip.

Rapid introduction of the thread into the thread insertion slit is achieved according to the invention by providing for widening of the thread insertion slit toward the outside of the cover. This ensures secure functioning, even when motion tolerances are great.

To economize air consumption during spinning, the thread insertion slit can be covered by a controllable closing element. The thread insertion slit is opened only for piecing and is covered up for the normal spinning process. Preferably the closing element is controllable, in coordination with the other phases of the piecing process, from a service carriage traveling alongside a plurality of open-end friction spinning devices.

As mentioned earlier, it is preferable if the thread draw-off can be adapted to the prevailing spinning conditions by providing for a delayed draw-off and/or a draw-off at reduced speed. Furthermore, in order to avoid damage to the friction spinning elements, a further feature of the invention provides for the friction spinning elements to be equipped with a thread monitor controlling their drive, and with an auxiliary driving device controllable from a service carriage traveling alongside a multiplicity of open-end friction spinning devices.

Although the thread is fed to the nip crosswise to its longitudinal sense, the friction spinning elements remain covered, according to the instant invention, during the entire piecing process. This makes it possible to obtain very individualized and variable control of the piecing process, adaptable in an optimal manner to the applicable spinning parameters (material, yarn thickness, etc.). This makes it possible to produce secure and short piecing joints, be it to repair thread breakage or in connection with bobbin replacement. Despite these optimized controls, the inventive device is simple and of space saving design.

BRIEF DESCRIPTION OF THE DRAWING

Several embodiments of the invention are illustrated in further detail through the drawings in which.

DETAILED DESCRIPTION OF THE INVENTION

Figure 1:
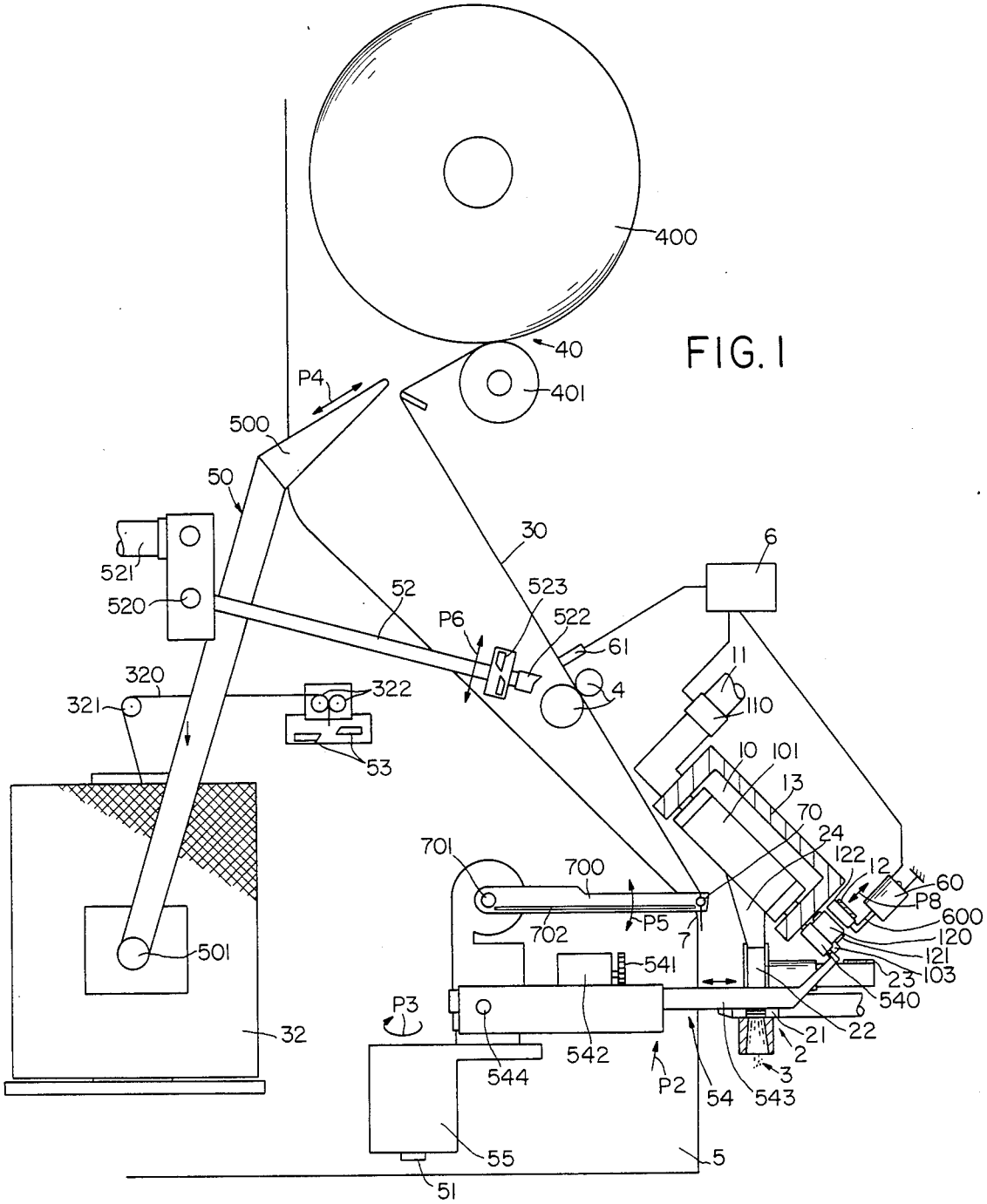
FIG. 1 is a schematic side view of a spinning station according to the invention, with an open-end friction spinning device and a movable thread clamp.

FIG. 1 shows an open-end friction spinning device 10 to which the fiber material 3 is fed by means of a feeding and opening device 2. To draw off the spun thread 30, a draw-off device 4 is provided. The drawn-off yarn is wound on a bobbin 400 which can be driven by a bobbin roller by means of a winding device 40.

The open-end friction spinning device 10, together with the feeding and opening device 2, is fixedly installed at the spinning station 1 of which, normally, a plurality is present, one next to the other, in one machine. A service carriage 5 carrying a piecing device 50 can travel alongside these spinning stations 1.

The open-end friction spinning device 10 has a housing 13 with two friction spinning elements 100 and 101 (FIG. 3) of rotational symmetrically design and forming a nip 102. At least one of the friction spinning elements, e.g., the friction spinning element 101 is perforated and subjected to suction in the area of the nip 102 during spinning. A valve 110 is connected to a suction air line 11 for that purpose (FIG. 1).

Figure 3:
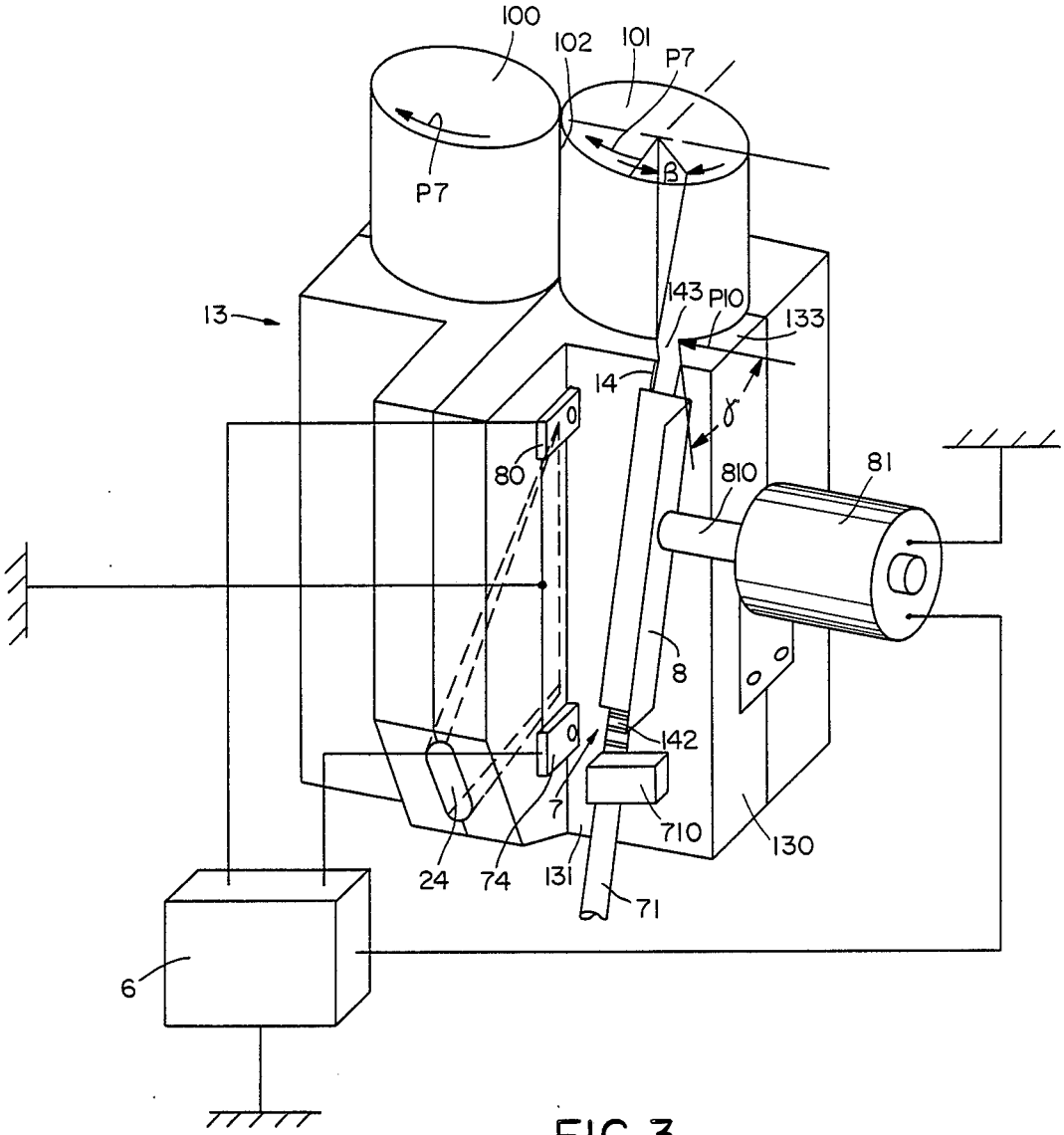
FIG. 3. is a perspective view of the friction spinning device of FIG. 2.

The two friction spinning elements 100 and 101, which are made in the form of rollers in the embodiment shown, are driven in the same direction (see arrows P7 in FIG. 3). For this purpose, each of the friction spinning elements 100 and 101 is provided with a wharve 103 to which a drive belt 120 is applied. The drive belt 120 is wrapped around two rollers 121 (of which only one is shown in FIG. 1) so that it is always in power transmitting contact with the wharve 103 of the two friction spinning elements 100 and 101. A drive roller 122 is applied to the outside of the drive belt 120 and is driven by a tangential belt 12 which extends over a plurality of spinning stations 1 located one beside of the other. The drive roller 122 is borne by the anchor 600 of a lifting magnet 60 which is controlled from a control unit 6 and can therefore be shifted in the direction of arrow P8.

The friction spinning elements 100 and 101 can also be driven by an auxiliary driving device 54 which is located on the service carriage. The auxiliary driving device 54 is equipped with a controllable drive roller 540 which is driven via a gearing 541 (indicated) by a motor 542. The drive roller 540 is seated on the end of a rod 543 which can be shifted in a longitudinal direction (arrow Pl).

To ensure that rod 543 can be moved freely in the longitudinal direction, it is furthermore capable of swiveling around a horizontal axle 544 in a vertical direction (arrow P2). Axle 544 is supported on a bearing block 55 which is in turn capable of being swivelled around a vertical axle (arrow P3), whereby it can bring the auxiliary driving device 54 from the zone of spinning station 1 back to the zone of service carriage 5.

The open-end friction spinning device 10 is preceded by a feeding and open-end device 2 equipped with a feeding funnel 20 by means of which the sliver shaped fiber material 3 is brought to a feeding roller 21 working together in the usual manner with a pressure roller or feeding tray (not shown). The fiber material 3 is conveyed from the feeding roller 21 to an opening roller 22 which opens the conveyed fiber material into individual fibers. The opening roller 22 is driven in a known manner by a belt 23. A fiber feeding channel 24 extends from the opening roller 22 to the nip 102 of the friction spinning elements 100, 101.

The thread 30 which is drawn off from the open-end friction spinning device 10 by means of draw-off device 4 is monitored by a thread monitor 61 on its way to bobbin 400 which is driven by a bobbin roller 401, said thread monitor 61 being in controlled connection with the control unit 6.

The piecing device 50 installed on the service carriage 5 is equipped with a suction pipe 500 which can swivel against bobbin 400 (arrow P4), said suction pipe 500 being capable of sucking up a thread end from said bobbin 400. Bobbin 400 can be driven in a known manner from the service carriage 5 in the unwinding sense, so that the sucked-up thread end gets back further and further into the suction pipe 500. Suction pipe 500 is provided with a longitudinal slit (now shown) on its side closest to spinning station 1, so that the sucked-up thread segment can travel a stretched course between the slit end furthest from bobbin 400, near the swiveling axle 501 of the suction pipe 500 and bobbin 400. Thread 30 thus reaches the swiveling range of a controllable thread clamp 70. Thread clamp 70 forms part of a thread holding device 7 and is installed on the free end of an arm 700 (see FIG. 5) which is supported on bearings on the service carriage 5 so as to be capable of executing a first swiveling motion in a horizontal plane (arrow P3) around swiveling axle 51, and a second swiveling motion in a vertical plane (arrow P5) around a swiveling axle 701. Arm 700 is, furthermore, equipped with a controllable compressed air nozzle 702.

A suction pipe 52, capable of being swivelled, is attachable to thread clamp 70, said suction pipe 52 being supported on a horizontal axle 520 so that it can be swivelled in a vertical swiveling place (arrow P6) from a take-up position near the thread clamp 70 into an intermediate position near the bobbin 400. Suction pipe 52 is connected to a source of negative air pressure (now shown) via a suction line 521.

Figure 4:
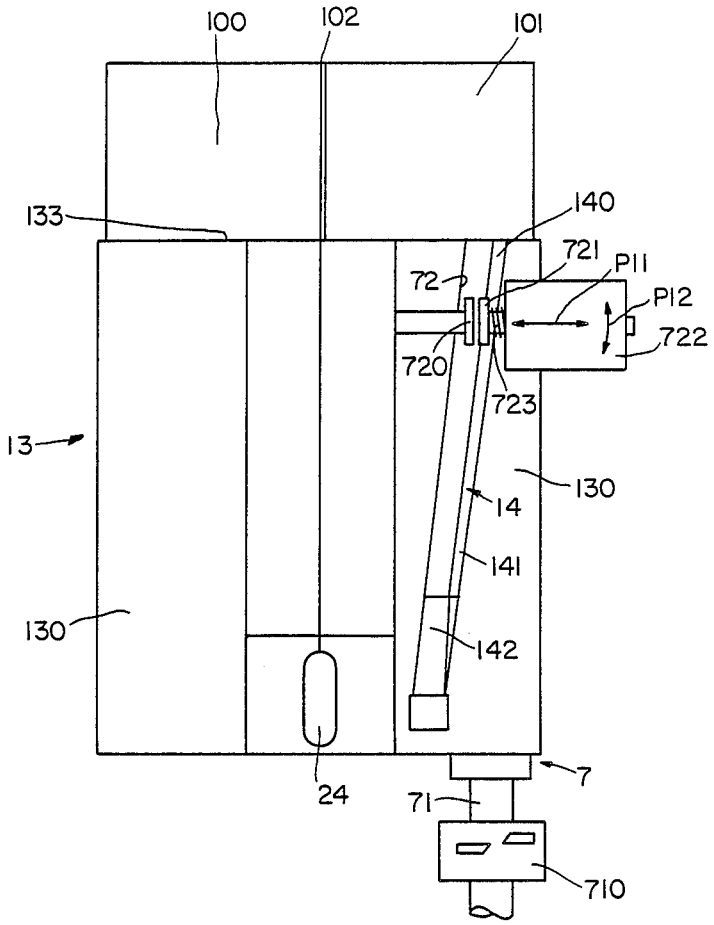
FIG. 4 is a front view of the device of FIG. 3.
Figure 5:
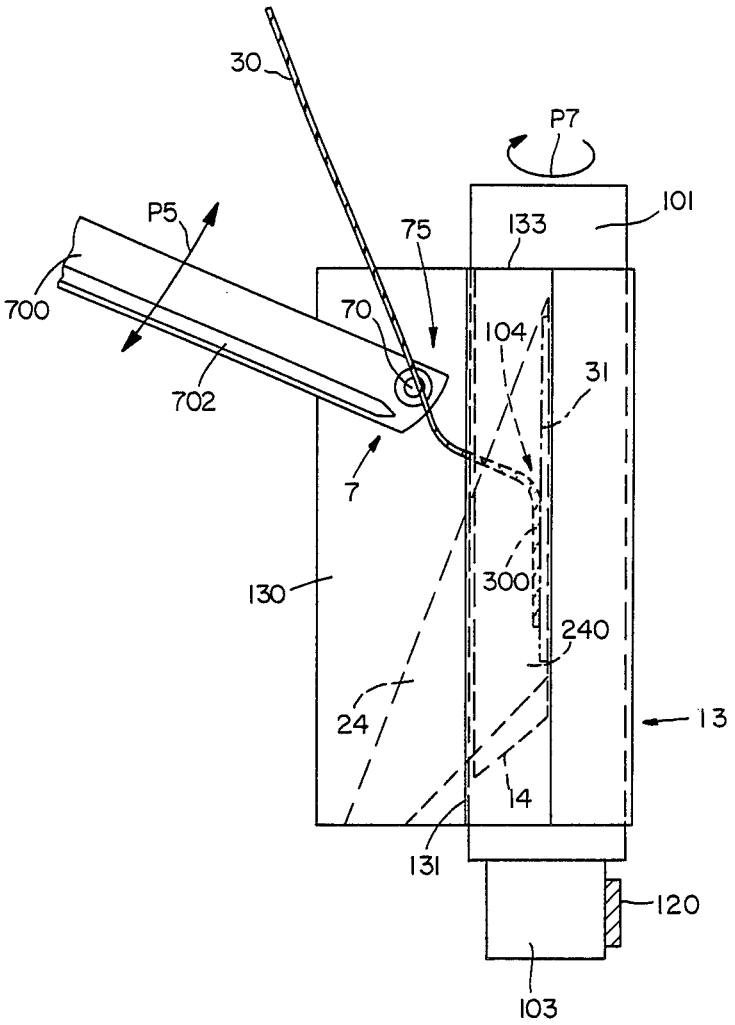
FIG. 5 is a side view of another embodiment of the device of FIG. 2 equipped with only a thread holding device made in the form of a thread clamp.

FIG. 4 shows a top view of the housing 13 while FIG. 5 shows a side view of housing 13. It can be seen from these drawings that the housing 13 has a thread insertion slit 14 in its cover 130 closest to the thread clamp 70. This thread insertion slit 14 extends from the outside 131 of the cover 130 up to its inside 132 and extends alongside to the fiber feeding channel 24 from the draw-off side 133 of the housing 13 up to the outlet end 240 of the fiber feeding channel 24 (FIG. 3) farthest from the draw-off side. Since the thread insertion slit 14 is located alongside to the fiber feeding channel 24, it lets out beside said fiber feeding channel 24 and thus outside the nip 102, in front of the friction spinning element 101 on the inside of housing 13.

The device whose configuration is described above operates as follows:

The service carriage 5 travels to the spinning station 1 at which piecing is to be carried out. This can be prompted by a signal given by the thread monitor 61 when a thread breakage occurs, or else for piecing after shut-down of the machine, when the service carriage 5 pieces up spinning station 1 after spinning station 1. At the spinning station 1, the suction pipe 500 is swivelled around its swiveling axis 501 against bobbin 400 which has already been lifted away from bobbin roller 401 earlier. While bobbin 400 is being driven from the service carriage 5 by means of an auxiliary drive roller (now shown) in the unwinding sense, suction 500 takes up thread 30 which is being unwound. Once a sufficient length of thread has been sucked into suction pipe 500, bobbin 400 is stopped and the suction pipe 500 is swivelled away from bobbin 400. At the same time thread 30 emerges from the above-mentioned longitudinal slit of the suction pipe 500. In doing this, it assumes a stretched position between the end of the longitudinal slit closest to the swiveling axle 501 and bobbin 400. Thread 30 is thus situated within the swiveling range of thread clamp 70. The thread clamp 70, capable of swiveling horizontally and vertically, is brought into a thread take-up position within the path of the thread and there takes up thread 30. It brings thread 30 to a cutting device 53 (FIG. 1), installed in the service carriage 5, which cuts through thread 30 on the side of thread clamp 70 which is furthest from bobbin 400. Thus, a defined thread length, required for piecing, is measured from the thread clamp 70 up to the end of thread 30. The thread clamp 70 is then swivelled in a combined horizontal and vertical movement toward the open-end friction spinning device 10. The thread clamp 70 is thus brought into a thread delivery position in front of thread insertion slit 14 (FIGS. 1 and 5); the thread clamp 70 thus constitutes a thread holding device 7 which presents the thread end 300 to the thread insertion slit 14. Here, the thread holding device, constituted by the thread clamp 70, holds thread 30 in a position that is essentially parallel to the thread insertion slit 14.

During this feed-back of the thread 30 into its piecing position in front of the thread insertion slit 14, the friction elements 100 and 101, which were stopped earlier by lifting off the drive roller 122 from drive belt 120, are once again made to rotate. For this purpose the drive roller 540 is brought to bear against drive belt 120 under direction from service carriage 5. The friction spinning elements 100, 101 now receive their driving force from motor 542 via drive roller 540 and drive belt 120. This drive is entirely independent from the machine's own drive (tangential belt 12) so that the friction spinning elements 100, 101 can be driven at a low speed which is especially advantageous for the piecing process.

The negative air pressure, previously switched off, is now applied once again to the friction spinning rollers 100, 101 by means of valve 110. Fiber feeding is now restarted in a known manner. The fiber sliver now arrives into the nip 102 in the form of individual fibers and is twisted together there in a thread forming zone 104 into a fiber bundle 31 (FIG. 5). The fiber bundle 31 is, however, not imparted true twisting in this case since it is able to rotate freely in nip 102.

In synchronization with the restarting of fiber feeding into the nip 102, compressed air is released in the compressed air nozzle 702 so that the thread end 300 is blown into the thread insertion slit 14 (FIG. 5). This compressed air assists the suction air stream flowing through the friction spinning element 101, subjected to aspiration. Thread end 300 thus reaches the suction-subjected circumferential surface of friction element 101 outside the nip 102. Under the influence of the negative pressure prevailing on the circumferential, the thread end 300 is taken along by the friction spinning element 101 rotating in the direction of nip 102 and is laid on top of the rotating fiber bundle 31. Fiber bundle 31, still constituting a relatively loose fiber amalgamation, is now twisted into the thread end 300.

From the above, it is seen that the thread end 300 does not come into contact with the fibers before reaching the nip 102, but that this contact occurs simultaneously with its reaching nip 102 and thereby thread forming zone 104. In this way, clean incorporation of the fibers into the thread end 300 is ensured. By controlling the rotational speed of the friction spinning elements 100, 101, i.e., by driving them at reduced speed during the piecing phase, it is possible to provide more time before thread draw-off begins and this increases the security of piecing.

As is clearly shown in FIG. 5, only the end of thread end 300 furthest away from the draw-off side reaches the nip 102 while the end of thread end 300 closest to the draw-off side is prevented by the thread clamp 70 from passing through the thread insertion slit 14 into the nip 102. Thus, the thread length coming into contact with the pre-fed fibers is short and as a rule, even shorter than the thread forming zone 104. This results in short piecing joints and thus in shorter faulty segments in the newly pieced thread. The required solidity of the piecing joints is achieved by relative control of fiber feeding, thread back-feeding speed of the friction elements 100, 101 and start-up of thread draw-off. In this way it is also possible to avoid a thin segment in the thread following the piecing joint.

The draw-off of the now reconstituted thread 30 from the thread forming zone 104 is effected through the continuation of the movement of arm 700 with the thread clamp 70 whereby, depending upon piecing speed, fiber material, etc., this may occur after interruption of the conveying and presentation movement of the thread holding device 7 or in uninterrupted continuation of this conveying and presentation movement.

The thread holding device 7 also constitutes a thread guide 75 for thread 30 and prevents, as mentioned, the end of thread end 300 closest to the draw-off side, from reaching the nip 102. However, as the distance between this thread holding device 7, constituting thread guide 75 increases, the newly formed thread 30 is laid over the entire length of thread forming zone 104 in the nip 102, even though thread 30 at first reaches the thread forming zone merely with its free end.

Bobbin 400 is also lowered back upon the bobbin roller 401 in timely coordination with the processes described above. Bobbin 400 begins to rotate in the direction of draw-off and to draw off the thread 30 from the open-end friction spinning device 10. The thread clamp 70 is now opened. Tension variations occurring because of slippage of the bobbin 400 as it accelerates are compensated for by the suction air stream in suction pipe 52. Suction pipe 52 stores the excess thread length until it is used up again by the tensioning delay during winding up.

Through the starting of thread draw-off by means of bobbin 400, the thread 30, due to increasing thread tension which may also be assisted by appropriate thread guiding elements (now shown), arrives into the clamping line of the draw-off device 4. Together with the lowering of bobbin 400 the reapplication of the drive roller 122 upon the drive belt 120 is effected via lifting magnet 60, while the drive roller 540 of the auxiliary driving device 54 again releases the drive belt 120 at the same time. The friction spinning elements 100 and 101 are thus again driven by the tangential belt 12 of the machine.

The device shown in FIG. 1 can also be used in connection with bobbin replacement. In this case, piecing can be carried out with the help of leader windings on the empty bobbin, so that the piecing process takes place in the manner described. The piecing joint and the remaining length of the leader windings can also be sucked away temporarily by means of suction pipe 52, whereupon the newly spun thread 30 is delivered to the empty bobbin by this suction pipe 52, a process that can be assisted in a known manner by means of a catch, etc. (now shown) of the winding device 40.

However, it is also possible to carry out bobbin replacement without leader windings on the empty bobbin. For this purpose an auxiliary bobbin 32 is seated on the service carriage 5, as shown in FIG. 1. The piecing thread 320 can be drawn off from said auxiliary bobbin through thread clamp 70. The piecing thread 320 is conveyed from the auxiliary bobbin 32 via a thread guide 321 and a thread clamp 322 up to the zone in which said piecing thread 320 can be seized by the thread clamp 70. The piecing thread 320 is led from the thread clamp 320 through the cutting device 53 where the piecing thread is given its precise piecing length.

Piecing is carried out as described earlier. The thread clamp 70 is moved in the direction of the bobbin winding device 40, up to the zone of outlet 522 of the suction pipe 52 during piecing draw-off. The thread clamp 70 is now controlled so that it releases thread 30 which is then sucked into suction pipe 52.

Suction pipe 52 is now swivelled toward the bobbin winding device 40 where the thread 30 is delivered to the empty bobbin. As the thread 30 is taken up by the bobbin winding device 40, a certain length of thread 30 is pulled out of the suction pipe 52. A cutting device 523 is located near the outlet 522 of the suction pipe 52 to cut off the thread end extending into the suction pipe 52 after delivery of the thread 30 to the empty bobbin. In this manner, during the exchange of a bobbin, the thread 30, which was earlier conveyed by the thread clamp moving in draw-off direction to the suction pipe 52 constituting a storage location, has been delivered to a newly inserted empty bobbin in the bobbin winding device 40.

It has been described above that the feeding of the fibers into the nip begins before the thread end 300 has reached the thread forming zone 104, but it is also possible, depending upon piecing speed, fiber material, etc., to control fiber feeding so that the fibers reach the nip 102 simultaneously with the thread end 300. The thread end 300 is thus constantly influenced by the fibers coming to lie on top of the thread end 300 for as long as it is in the nip 102 and is thus prevented from snapping together under the effect of the increasing torsion in thread 30.

To obtain strong piecing joints, measures are taken in an alternate embodiment of the piecing process described to free the circumferential surfaces of the friction spinning elements 100 and 101 from residue fibers. For this purpose, the fibers are briefly fed to the stopped friction spinning elements 100 and 101 which, however, continue to be subjected to suction, even before thread end 300 arrives in front of the thread insertion slit 14. Fiber feeding and suction of the friction spinning elements 100 and 101 are stopped. The fibers are then sucked out of nip 102. This can be done, for example, by opening the cover 103 away from the remainder of the housing 130 containing friction spinning elements 100 and 101 and applying in its stead a controllable suction bell (not shown) brought by the service carriage 5 to the front of the friction spinning elements 100, 101. Alternately, the friction spinning elements 100, 101 can also be spread apart in a known manner so that the fibers may be sucked away by means of a suction device (not shown) which is located on the side of the friction elements 100 and 101 furthest from the fiber feeding channel 24. The temporary feeding of fibers increases the fiber residue mass remaining in nip 102, so that removal of the fibers by suction is facilitated. This cleaning of the friction spinning elements 100 and 101 ensures uniform piecing conditions, independently of the residue fibers in the nip which have been caused by thread breakage. Fiber feeding for the piecing procedure is then coordinated in time with the prior discontinuation of fiber feeding so that the fiber tuft is always in the same state for piecing. The moment of introduction of the thread 300 into the thread insertion slit 14 must then be selected in relation to the moment of fiber feeding for piecing.

When thread breakage occurs, it is unavoidable for a more or less great quantity of fiber residue to remain in the nip 102 of friction spinning elements 100, 101. When the friction spinning elements 100, 101 rotate without draw-off traction being exerted upon said fiber mass, it can happen that this fiber mass adheres to the friction spinning elements 100, 101 and runs several times through the contact line of friction spinning elements 100, 101. To prevent this, an alternate method consists in not only discontinuing fiber feeding into nip 102 in case of thread breakage, but in addition to stop the friction spinning elements 100, 101 immediately. Prompted by the thread breakage signal emitted by the thread monitor 61, the control unit 6 causes the drive roller 122, driven by tangential belt 12 to be separated from tangential belt 120 under the action of lifting magnet 60 so that said belt 120 stops running. The restarting of the friction spinning elements 100 and 101 which is required for piecing is then effected from the service carriage 5 and via auxiliary driving device 54. Fiber feeding is started and the fiber end 300 is fed to the nip in the manner described.

To facilitate introduction of the thread end 300 into the thread insertion slit 14, the latter widens into a wedge shape as shown in FIG. 3 toward the outside 131 of the cover 130. For the thread end 300 to be conveyed to the thread forming zone in a stabilized condition, the least angle $\beta$ between thread insertion slit 14 and thread forming zone 106 must be at least 90°. According to FIG. 3, this angle $\beta$ between the end of outlet 143 of the thread insertion slit 14 letting out the inside 132 of cover 130 and the thread forming zone 104 is even greater. Furthermore, the thread insertion slit 14 forms an angle $\gamma$ of inclination less than 90° with the direction of rotation (arrow P10) of the friction spinning element 101 rotating toward the nip 102.

As mentioned earlier, the thread clamp 70 prevents the thread end 300 on the draw-off side from getting into the thread forming zone 104, at least not before the end of this thread segment, furthest from the draw-off side, has reached the thread forming zone 104. This effect can be assisted or can be achieved entirely by laying the thread end 300 obliquely on the friction spinning element 101 which rotates toward nip 102 so that the thread end furthest from draw-off, i.e., the free end, is at a lesser distance from the nip 102 than the other end of said thread end 300, on the draw-off side, at the moment when it is laid down on the friction element 101. For this purpose, as shown in the embodiment of FIGS. 3 and 4, provisions are made for the end of the thread insertion slit 104 closest to draw-off to be at a greater distance from the thread forming zone 104 than the end 141 of the thread insertion slit 14 furthest from draw-off.

The presentation of the thread 30 by the thread clamp 70 to the thread insertion slit 14 can be effected in different ways. As shown in FIG. 1, the thread clamp 70 can be swivelled in a horizontal as well as in a vertical plane so that the thread can also be fed to the thread insertion slit 14 from the side. To make it possible for the thread clamp 70 to be also used as a withdrawal or draw-off element for the duration of the piecing process, said thread clamp 70 is moved into the zone of thread insertion slit 14, preferably at a parallel, i.e., in the direction of the thread draw-off, to said thread insertion slit 14 because the thread can thus be brought to said thread insertion slit 14, and thereby to the nip 102 in this manner by means of one and the same swiveling motion, possibly with a brief interruption in the area of thread insertion slit 14 and can then be drawn off from nip 102.

To ensure that the thread end 300 is of exactly the desired length when it reaches the thread forming zone, the position for piecing is selected in a very precise manner. First, thread 30 is cut to a defined length by the cutting device 53 and is brought up to the longitudinal reach of the thread forming zone 104 outside the nip 102 where it is still held by the thread clamp 70 as before. This piecing position is determined so that when fiber feeding is switched on, the thread end 300, which is now sucked into thread insertion slit 14 by the negative air pressure at the suction-subjected friction spinning element 101, reaches the nip 102 within the length limits of the thread forming zone 104, but does not extend beyond it at either of its ends. In this way, thread 30 is laid in a precisely determined length on the fibers which are in nip 102, forming a rotating fiber bundle 31.

From the above, it is obvious that the compressed air nozzle 702 can be dispensed with, in principle, since thread 30 is sucked up solely under the influence of the negative air pressure prevailing at the friction spinning element 101. The compressed air nozzle 702 thus merely has an assisting role to play and makes it possible to feed the thread end 300 to nip 102 faster and also with greater timing precision.

In this embodiment, the thread clamp 70 can be moved in the direction of the thread insertion slit 14. It has been shown to be of advantage, for a secure piecing process, to dispose of different distances between the thread clamp 70 and the end of nip 102 on the draw-off side and, therefore, from the thread forming zone 104, during the conveying of thread end 300 to the thread forming zone 104 and, thus to the nip 102. That's why thread clamp 70 is made to be variable, i.e., for its delivery position to be adjustable. The thinner the thread is, the greater should be the length of the thread end 300 in the thread forming zone. Reciprocally, the thread length within the nip 102 need not be as great for thicker yarns. This is due to the fact that the quantity of fibers conveyed is smaller per unit with thin yarns than with thicker yarns so that the fiber mass required to constitute a sufficiently solid piecing joint is attained only after a somewhat longer period of time.

Alternately, or in addition to the measures described for increasing the solidity of the piecing joint, provisions can be made for laying down the thread end 300 on the fibers which are in nip 102 later after switching on fiber feeding when thin threads are involved than with thick threads. Despite the smaller quantity of fibers delivered per time unit a sufficient mass of fibers can thus accumulate in nip 102 so that secure piecing is ensured. This timing control is effected by controlling the movement of arm 700 and compressed air nozzle 702 appropriately.

Another measure is the adapted control of the draw-off of thread 30 from the thread forming zone 104. To give the thread end 300 sufficient time to combine with the fiber bundle 31 in nip 102 is being twisted in, thread 30 is merely subjected to delayed draw-off after having reached the thread forming zone 104. This is effected, in the described embodiment, by stopping the thread clamp 70 for the introduction of thread end 300 into the thread insertion slit 14 and through the observance of a certain period of stoppage until the beginning of the swiveling motion of thread clamp 70, which causes the draw-off. If the piecing draw-off process takes place after release of thread 30 by the bobbin 400, the moment for the lowering of bobbin 400 upon bobbin roller 401 must be selected accordingly. Here too, the delay up to start-up of thread draw-off must be greater for thin threads than for thick threads.

Since thread end 300 continues to be held for a certain period of time by thread clamp 70, even after being conveyed to the nip 102, this ensures that thread 30 reaches the area of the thread forming zone 104 first only with its free end and only afterwards with its end on the draw-off side. The conveying of the thread end 300 into the nip 102 can, however, be accomplished also by stopping the clamping action of the thread clamp 70 whereby piecing draw-off is then carried out by bobbin 400, which is again lowered upon the bobbin roller 401. If this contact between the thread segment on the draw-off side and the thread forming zone 104 is to be further delayed, even after release of the thread clamp 70 and in spite of resumed thread draw-off (through bobbin 400), this can be accomplished by means of a thread guide 73 (FIG. 2) installed on the draw-off side before the friction spinning elements 100, 101, which can be brought from the shown position into position 73 indicated by broken lines. This thread guide can consist, for example, of a yoke that can be swivelled in the direction of arrow P9. Thereby, the thread 30 which is drawn off from the thread forming zone 104 is deflected in the direction of fiber feeding, i.e., toward the side nearest to the fiber feeding channel 24.

Figure 2:
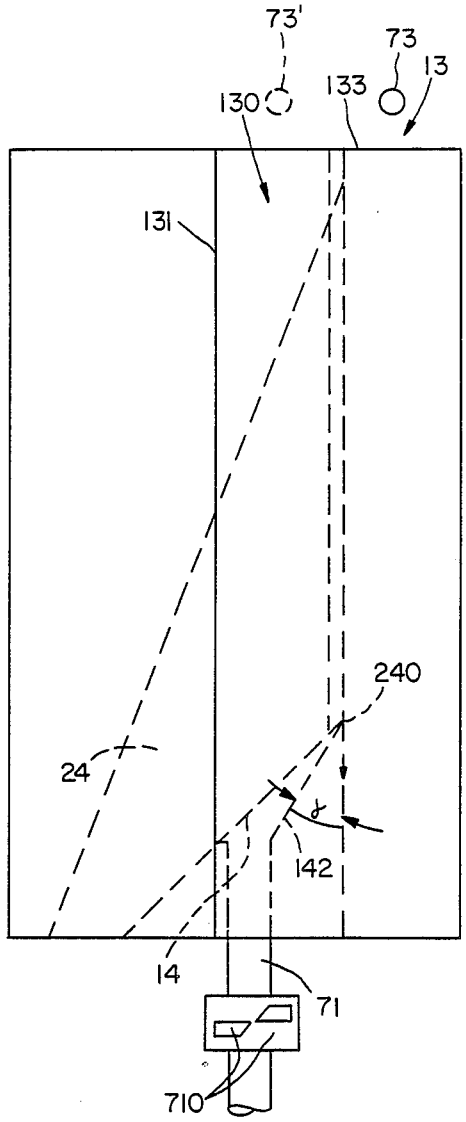
FIG. 2 is a schematic side view of a friction spinning device according to the invention, equipped with a thread holding device made in the form of a suction air nozzle as well as of a thread clamp.

Another embodiment of the device is described hereinbelow through FIGS. 2 to 4. As these drawings clearly show, the thread insertion slit 14 is separated from the inside 132 of cover 130 by a slit bottom 142 at its end away from the draw-off side. In the embodiment shown, this slit bottom 142 forms a sharp angle $\alpha$ with the inside wall of the cover 130.

The thread holding device 7 in this embodiment is constituted by a suction air nozzle 71 which comes from the side away from the draw-off and runs into the end 141 of the thread insertion slit 14. For reasons of design (space saving) the suction air nozzle 71 ends parallel to the thread forming zone 104 in slit bottom 142 in this embodiment.

Thread 30 is brought from bobbin 400 up to a point in front of the thread insertion slit 14 by means of a conveying element, e.e., of the type of the thread clamp 70 shown in FIGS. 1 and 5, and is subjected to the effects of the controllable suction air stream in the suction air nozzle 71. This suction air stream exerts an elastic retention force upon thread 30 and continues to draw it off upon release by thread clamp 70 until said thread 30 is stopped by the stoppage of bobbin 400 which is reversed in its rotation during thread feed-back. The movable thread clamp 70 now releases the thread so that it is held only by the suction air nozzle 71.

In order to prevent, during extensive machine stoppages, the thread which goes from bobbin 400 to the now inactive suction air nozzle 71 from forming loops which could interfere with proper functioning during piecing, a fixed thread clamp 72, constituting a rigid clamping element is additionally provided at each spinning station according to FIG. 4. In the embodiment shown, this clamp is equipped with a rigid clamping element 720 working together with a movable clamping element 721 (arrow Pll). This movable clamping element 721 can be moved by a lifting magnet 722 in the one direction of movement and is pulled back by a retention spring 723 in the other direction.

To feed the thread end 300 to the nip 102, the suction air in the suction air nozzle 71 is switched off so that thread 30 is released by thread clamp 72 and so that thread end 300 is sucked into the thread insertion slit 14 by the negative air pressure at the friction spinning element 101. The thread end 300 slides along the bottom 142 of the slit. To prevent the thread end 300 from jumping away from the slit bottom 142 and, thus, to prevent uncontrolled movement of the thread end 300, this slit bottom 142 is inclined toward the nip 102 at an acute angle $\gamma$. To ensure in this embodiment that the free end of this thread end 300 comes into contact with the fibers in nip 102 before the thread segment on the draw-off side, the thread guidance 73, shown in FIG. 2, is brought from its shown position into position 73 for piecing. In this way, thread 30 is deflected in the direction of fiber feeding during the piecing process.

To adapt to the different yarn thicknesses, thread clamp 72 can be made so that it can be brought into different positions parallel to nip 102 (arrow P12) in the embodiment shown in FIG. 4.

To obtain a defined thread length for piecing, different methods can be used. It is possible, for example to bring thread 30 to a defined length by means of the earlier-mentioned cutting device 53. Thread 30 is then brought to the thread holding device 7 constituted by the suction air nozzle 71 and is conveyed for a defined length outside nip 102 into suction air nozzle 71, over and beyond the end of thread forming zone 104, which is furthest from the draw-off. This can be effected, for example, by releasing a previously formed thread reserve. Fibers are then fed into nip 102. Thread 30 is drawn off in a time controlled manner, counter to the elastic retention force which is exerted by suction air nozzle 71 upon thread 30 until the thread 30 leaves the effective range of the elastic retention force of said suction air nozzle 71 and is passed through the thread insertion slit 14 to be laid on the fibers which are in the nip in thread forming zone 104. The desired time for the thread end 300 to remain in the thread forming zone 104 can be determined here by temporary discontinuation of thread draw-off.

To make it possible for the time tolerances for the feed-back of thread 30 into the suction air nozzle 71 to be kept relatively wide, a cutting device 710 is provided in the suction air nozzle 71 according to the embodiment shown in FIG. 4 to give the fed-back thread 30 a defined length. In addition, this cutting device 710 causes the thread end which has lost its definition as to length and form due to unwinding and loss of individual fibers through suction, as a result of pneumatic feed-back and holding, to be given once more a defined form.

According to FIG. 3, to ensure precise control of the piecing process, the cover 130 is equipped with an initiator 80 to control a closing element 8 by which the thread insertion slit 14 is covered during stoppage of the spinning station 1 and during normal spinning operation. The closing element 8 extends at a parallel to the thread insertion slit 14, essentially over its entire length, and is connected to the anchor 810 of a lifting magnet 81 which, in turn, is controllably connected to the initiator 80 via controlling element 6.

The initiator 80 is installed on cover 130 so that the closing element 8 lays open the thread insertion slit 14 immediately once the arm 700, displaced in the direction of the suction air nozzle 71, reaches cover 130. Its location on the draw-off side or on the opposite side of the cover 130 therefore depends on the direction from which thread 30 is brought in.

A switch flag 74 is furthermore provided in the cover, said switch flag provoking an impulse in a switch (not shown), constituting an initiator on arm 700, when the thread clamp 70 has reached its point of delivery. This second initiator causes opening of the thread clamp 70 so that the thread 30 can be sucked into the suction air nozzle 71. In addition, this second initiator can be connected to a controlling device to control the piecing process and to initiate the piecing program.

In the embodiment described, in which each spinning station 1 is pieced up individually, the closing element 8 is controllable from the service carriage 5 travelling alongside the machine. If, however, a device is provided for mass piecing of a plurality of open-end friction spinning devices 10, then this closing element 8 can also be controlled from the centrally controllable controlling device on the machine.

As can be seen from the above description, the object of the invention can be attained in a number of ways and is, therefore, not limited to the embodiments shown as examples. Further variations are possible through the exchange of characteristics among each other or through their replacement by equivalents and through combinations thereof, all falling within the framework of the instant invention. The invention is therefore not limited to the design of a thread feed-back device made in the form of a thread clamp 70, since a pneumatic grasper can also be used instead of said thread clamp 70.

In the embodiments shown as examples, the fiber feeding channel 24 runs directly into the thread forming zone 104, while the thread insertion slit 14 ends in front of the peripheral surface of the friction spinning element 101 which is subjected to air suction. With appropriately timed control of fiber feeding and thread feed-back, provisions can also be made for the fibers to be fed on the peripheral surface of the friction spinning element 101 and to be brought into the thread forming zone 104 by its rotation while the thread insertion slit runs directly into the thread forming zone 104.

I claim:

1. A process for piecing up a downed end in an open-end friction spinning device which has two friction spinning elements driven in the same direction which form a nip subjected to suction, one of the ends of this nip forming a draw-off end, comprising steps of:

(a) feeding a thread end into a piecing position outside of said nip;

(b) transferring said thread end to a thread forming zone in said nip; while keeping a thread portion between said thread end and said draw-off end out of said nip; and (c) feeding opened fibers to said thread forming zone whereby the feeding of the fibers into the nip is controlled so that the thread end comes into contact with the fibers at the same moment it reaches said thread forming zone after which the thread is drawn off effecting piecing of the thread.

2. In a process as set forth in claim 1, wherein the feeding of the fibers into the nip begins before the thread end has reached the thread forming zone.

3. A process as set forth in claim 1, wherein fiber feeding to the friction spinning elements is discontinued when thread breakage occurs, and the friction spinning elements are stopped upon said thread breakage and are started up again while the thread is fed back into the piecing position outside of the nip, whereupon the feeding of the fibers into the nip is resumed.

4. A process as set forth in claim 1, wherein the friction spinning elements are driven at a reduced speed while the thread end is fed into the thread forming zone and until after startup of the thread draw-off.

5. A process as set forth in claim 1, wherein the thread is drawn off from the thread forming the zone so as to be deflected in the direction of the fiber feeding side of said thread forming zone.

6. A process as set forth in claim 1, wherein the thread is laid outside of the nip upon the friction spinning element rotating towards the nip and is fed into the nip by rotation of said friction spinning element.

7. A process as set forth in claim 6, wherein the thread end is laid obliquely upon the friction spinning element rotating towards the nip so that the distance separating the free thread end from the nip is smaller than the distance between said thread portion on the draw-off side of said friction spinning element and the nip.

8. A process as set forth in claim 1, wherein the piecing position is selected so that the thread end is brought into said piecing position and delivered into said thread forming zone before it is subjected to draw-off and extends only as far as into the thread forming zone to which the fibers are fed.

9. A process as set forth in claim 8 wherein the thread is fed to the nip through a clamping device which is movable in the direction of the thread draw-off and said thread is then drawn off from the nip.

10. A process as set forth in claim 9, wherein the thread is delivered to a storage location by the movable clamping device.

11. A process as set forth in claim 10, wherein the thread formerly fed to a storage location by the clamping device which is movable in the draw-off direction is conveyed to a newly installed empty bobbin.

12. A process as set forth in claim 1, wherein the thread is brought to a predetermined length and is fed outside the nip to the length of the thread forming zone, the thread end being held in that position by clamping means, and fibers are then fed to the nip and the thread is laid on the fibers which are in the nip.

13. A process as set forth in claim 12, wherein the thread end is clamped at a greater distance from the draw off end of the nip when said threads are thin than when said threads are thick.

14. A process as set forth in claim 12, wherein the thread is laid on the fibers in the nip by discontinuing clamping of the thread.

15. A process as set forth in claim 12, wherein the feeding of the thread to the nip is assisted by a current of compressed air.

16. A process as set forth in claim 1, wherein the thread is brought to a defined length, is then fed back by a predetermined distance outside of the nip and beyond the end of the thread forming zone furthest from the draw-off side, up to the range of influence of an elastic retention force and the fibers are then fed to the nip and the thread is then drawn off counter to the elastic retention force and is laid on the fibers in the nip upon leaving the range of influence of the elastic retention force.

17. A process as set forth in claim 1, wherein thin threads are laid onto the fibers which are in the nip at a later point in time than are thick threads.

18. A process as set forth in claim 1, wherein the draw-off of the thread is delayed until the thread end reaches the thread forming zone.

19. An open-end friction spinning device, having two friction spinning elements driven in the same direction for spinning a thread, which form a nip, one of the ends of this nip forming a draw-off end, comprising:

(a) a cover covering said friction spinning elements having a fiber feeding channel and a thread insertion slit disposed alongside to said fiber feeding channel and extending along the longitudinal axis of said friction spinning elements, from the exterior of said cover to the interior of said cover, and from the end of said fiber feeding channel to the draw-off end to at the most the outlet end of said fiber feeding channel furthest from the draw-off;

(b) a thread holding device disposed outside the nip, which holds the thread substantially parallel to said thread insertion slit; and (c) a thread guide disposed to hold a portion of the thread between a thread end and said draw-off end outside of the nip of the friction elements until the thread end reaches the nip, whereby the thread end is fed into a piecing position outside of the nip and is transferred to a thread forming zone in the nip after which the thread is drawn off effecting piecing of the thread.

20. An open-end friction spinning device as set forth in claim 19, wherein said thread guide is shaped as a reverser which deflects the thread leaving the friction spinning elements in the direction of the cover.

21. An open-end friction spinning device as set forth in claim 19, wherein the thread insertion slit in its area away from the draw-off end is separated from the interior of the cover by a slit bottom.

22. An open-end friction spinning device as set forth in claim 21, wherein the slit bottom forms a sharp angle with the inside wall of the cover.

23. An open-end friction spinning device as set forth in claim 21, wherein the thread holding device is formed as a suction air nozzle which is located in said slit bottom.

24. An open-end friction spinning device as set forth in claim 23, wherein the suction air nozzle runs into the slit bottom in a direction parallel to the thread forming zone.

25. An open-end friction spinning device as set forth in claim 19, wherein the thread holding device is formed as a suction air nozzle which runs into the end of the thread insertion slit away from the draw-off end.

26. An open-end friction spinning device as set forth in claim 19, wherein the thread holding device is formed as a thread clamp.

27. An open-end friction spinning device as set forth in claim 26, wherein a separating device is associated with said thread clamp.

28. An open-end friction spinning device as set forth in claim 26, wherein the thread clamp can be moved from a thread take-up position wherein a thread drawn off from a bobbin is taken up into a thread delivery position in which the thread is delivered into the thread insertion slit.

29. An open-end friction spinning device as set forth in claim 28, wherein said movable thread clamp is equipped with a switch which is connected to controls controlling the piecing process and which can be activated from the cover when the thread delivery position is reached.

30. An open-end friction spinning device as set forth in claim 26, wherein the thread clamp is adjustable alongside the thread insertion slit.

31. An open-end friction spinning device as set forth in claim 30, wherein the thread clamp can be moved in the direction of thread draw-off to the outlet of a pneumatic storage located between the friction spinning elements and a bobbin winding device in order to deliver the thread end to the thread insertion slit and is adapted to be controlled in such a manner that the thread clamp releases the thread only within reach of the pneumatic storage.

32. An open-end friction spinning device as set forth in claim 31, wherein an auxiliary bobbin is installed on a service carriage which travels alongside a plurality of said open-end friction spinning devices whereby the said thread can be fed from said auxiliary bobbin to the thread clamp.

33. An open-end friction spinning device as set forth in claim 26, wherein a compressed air nozzle pointing into the thread insertion slit is associated to said thread clamp.

34. An open-end friction spinning device as set forth in claim 19, wherein the fiber feeding channel ends at said nip and the thread insertion slit ends outside of said nip in front of the peripheral surface of the friction spinning element which rotates towards said nip.

35. An open-end friction spinning device as set forth in claim 34, wherein the end of the thread insertion slit on the draw-off end is a greater distance from the thread forming zone than the end of said thread insertion slit on the side away from said draw-off end.

36. An open-end friction spinning device as set forth in claim 34, wherein the angle formed by an outlet of the thread insertion slit and the thread forming zone is greater than 90°.

37. An open-end friction spinning device as set forth in claim 34, wherein the thread insertion slit forms an angle of inclination of less than 90° with the direction of rotation of the friction spinning element rotating toward said nip.

38. An open-end friction spinning device as set forth in claim 19, wherein the thread insertion slit widens in the direction of the exterior of the cover.

39. An open-end friction spinning device as set forth in claim 19, wherein the thread insertion slit is covered by a controllable closing element.

40. An open-end friction spinning device as set forth in claim 39, wherein the closing element is controlled from a service carriage which travels alongside a plurality of open-end friction spinning devices.

41. An open-end friction spinning device as set forth in claim 19, wherein a thread monitor is associated with the friction spinning elements which thread monitor controls the drive of said elements and wherein further an auxiliary driving device is associated to the friction spinning elements which auxiliary driving device is controllable from a service carriage which travels alongside a plurality of such open-end friction spinning elements.

* * * * *